US006766967B2

(12) United States Patent
Harris et al.

(10) Patent No.: US 6,766,967 B2
(45) Date of Patent: Jul. 27, 2004

(54) MAGNET-DRIVEN ROTARY NOZZLE

(75) Inventors: Jaime L. Harris, Rosemount, MN (US); Gary A. Brown, Faribault, MN (US); Brad S. Kessler, Inver Grove Heights, MN (US)

(73) Assignee: GP Companies, Inc., Mendota Heights, MN (US)

( * ) Notice: Subject to any disclaimer, the term of this patent is extended or adjusted under 35 U.S.C. 154(b) by 0 days.

(21) Appl. No.: 10/140,691

(22) Filed: May 7, 2002

(65) Prior Publication Data

US 2003/0209611 A1 Nov. 13, 2003

(51) Int. Cl.[7] ..... B05B 3/06; B05B 3/04; B05B 3/00

(52) U.S. Cl. ..... 239/251; 239/240; 239/256; 239/263.3; 239/222.21

(58) Field of Search ..... 239/251, 256, 239/263.1, 263.3, 225.1, DIG. 11, 380, 381, 236, 237, 222.21, 240

(56) References Cited

U.S. PATENT DOCUMENTS

| | | | | |
|---|---|---|---|---|
| 4,802,628 A | | 2/1989 | Dautel et al. | |
| 4,811,906 A | | 3/1989 | Prus | |
| 4,913,346 A | * | 4/1990 | Nakamura et al. | 239/225 |
| 5,039,013 A | | 8/1991 | Sawade et al. | |
| 5,060,862 A | | 10/1991 | Pacht | |
| 5,141,158 A | | 8/1992 | Allen | |
| 5,217,166 A | * | 6/1993 | Schulze, deceased et al. | 239/227 |
| 5,236,126 A | | 8/1993 | Sawade et al. | |
| 5,328,097 A | | 7/1994 | Wesch et al. | |
| 5,332,155 A | | 7/1994 | Jager | |
| 5,395,053 A | | 3/1995 | Frech | |
| 5,456,413 A | | 10/1995 | Ellis | |
| 5,551,635 A | | 9/1996 | Jager | |
| 5,597,119 A | | 1/1997 | Gorney et al. | |
| 5,598,975 A | | 2/1997 | Jager | |
| 5,871,023 A | * | 2/1999 | Sherman, Jr. et al. | 134/167 |
| 5,908,349 A | | 6/1999 | Warehime | |
| 5,922,131 A | | 7/1999 | Haas | |
| 5,941,458 A | * | 8/1999 | Hartmann | 239/381 |
| 6,027,040 A | | 2/2000 | Frye-Hammelmann | |
| 6,196,475 B1 | * | 3/2001 | Jaeger | 239/381 |
| 6,250,566 B1 | | 6/2001 | Jager | |
| 2002/0107132 A1 | * | 8/2002 | Fischer et al. | 494/49 |

FOREIGN PATENT DOCUMENTS

| | | |
|---|---|---|
| DE | 41 33 973 A1 | 4/1992 |
| DE | 297 16 005 U1 | 12/1997 |
| DE | 197 35 550 A1 | 1/1998 |
| DE | 100 40 347 A1 | 2/2002 |
| EP | 0 810 035 A2 | 12/1997 |
| JP | 5-154450 | 6/1993 |

* cited by examiner

*Primary Examiner*—Kevin Shaver
*Assistant Examiner*—Anuradha Ramana
(74) *Attorney, Agent, or Firm*—Oppenheimer Wolff & Donnelly LLP

(57) ABSTRACT

A high-pressure rotary nozzle includes a magnetic coupling for the purposes of driving a rotor body within the nozzle housing. The nozzle housing defines an internal chamber, and a propulsion ring is retained within the housing such that a liquid introduced into the propulsion ring causes the propulsion ring to rotate and passes into the chamber. The rotor body is pivotally supported within the chamber and is operably coupled to the propulsion ring such that the rotor body moves along with the propulsion ring. The rotor body rotates about the housing, such that the liquid exits the chamber in a rotating jet.

20 Claims, 5 Drawing Sheets

MAGNET-DRIVEN ROTARY NOZZLE

FIELD OF THE INVENTION present invention relates to a rotary nozzle, especially one used for high pressure cleaning. The nozzle includes a propulsion ring that drives an inclined rotor body about its axis thereby causing a liquid to exit the rotary nozzle in a rotating jet.

BACKGROUND OF THE INVENTION nozzles that provide a high-pressure stream of cleaning fluid are used for a variety of cleaning applications. Many such systems implement a nozzle housing, with an inlet, an outlet, an internal housing chamber, and a rotor body disposed in the chamber at an incline. By connecting the inlet to an appropriate hose, a high-pressure liquid is introduced into the inlet, entering the chamber along a tangential path. The liquid flow causes the rotor body to rotate about the housing chamber, the side of the nozzle bearing along an interior side of the housing. The liquid exits the rotary nozzle through the outlet as a rotating jet. The jet is intended to assist the cleaning efficiency, avoiding spot treatment, and enhance uniformity.

Existing nozzles rely upon the force of swirling liquid in the housing chamber to create the desired rotating jet. The operation of these nozzles, however, depends upon the frictional force between the rotor body and the interior side of the housing. As the rotor body and housing begin to wear, the friction between the two surfaces changes. Accordingly, the same nozzle configuration may lead to significantly differing rotation speeds and impact levels owing to wear on the nozzle elements.

Further, as the surfaces exhibit deterioration, an increased level of friction between the two surfaces leads to a decreased startup speed—the time from the liquid first flowing into the nozzle to the time the rotating fluid jet reaches its maximum speed. Slow startup speeds can be damaging to the target being cleaned by the nozzle; a sluggish acceleration of rotation speed of the fluid jet can abrade the target. By focusing solely on the friction between the two surfaces, the prior art has inadequately addressed these and other shortcomings of existing rotary nozzles.

Furthermore, existing rotary nozzles provide insufficient control over the impact—the concentration of liquid in a specific location on the cleaning target—and stream quality—the precise placement of all the liquid particles in a uniform diameter on the cleaning target—of their rotating jets. The impact a rotating jet has on its target is attributable to the flow rate of the liquid exiting the nozzle and the rotation speed of the liquid. Because of the aforementioned varying level of friction, prior rotary nozzles have provided only limited ability to determine and maintain the impact of their rotating jets. Similarly, control of the stream quality of these rotary nozzles has also been limited. The stream quality is considered to be the clarity of the water stream exiting the nozzle; the diameter restraint and uniformity of the rotating jet.

BRIEF SUMMARY OF THE INVENTION

For these reasons, it is an object of the present invention to provide a rotary nozzle that does not rely solely on a high-pressure fluid to directly rotate the nozzle body. It is an additional object of the present invention to provide a rotary nozzle that effectively maintains a desired flow rate and rotation speed of the exiting rotating jet and enhances the stream quality of the rotating jet, which contributes to the cleaning efficiency of the rotary nozzle. It is yet another object of the present invention to provide a maximized startup speed in a rotary nozzle and substantially maintain that startup speed over the life of the rotary nozzle.

A high-pressure rotary nozzle of the present invention includes a housing defining an internal chamber, the housing having a top end and a bottom end, the bottom end having an outlet. An endcap assembly is attached to the top end of the housing and defines an endcap bore. The endcap bore is essentially a liquid passage that runs through the center of the endcap assembly and opens into a drive orifice that is tangential to the endcap bore. The endcap assembly also includes a propulsion ring that is rotatably disposed in the endcap assembly about the endcap bore. A drive magnet is fixedly attached to the propulsion ring such that the drive magnet and the propulsion ring rotate together.

Inside the housing chamber, a rotor body having an internal rotor bore therethrough is rotatably disposed and extends longitudinally through the housing chamber. The rotor body is supported in a rotor seat, which is fixedly attached to the housing at the outlet. The rotor body is disposed in the housing chamber at an angle such that a bearing surface of the rotor body bears on an interior side of the housing. A receiver magnet is fixedly attached to the rotor body, such that rotation of the drive magnet produces rotation of the receiver magnet. The rotation of the receiver magnet causes the rotor body to rotate with respect to housing such that the liquid flowing through the internal rotor bore exits the outlet in a rotating jet.

In operation, a liquid is introduced into the endcap bore at a high pressure and exits through a drive insert orifice tangential to the endcap bore. As the liquid exits through the drive insert orifice, it strikes the propulsion ring, thereby propelling the propulsion ring to rotate at a high rate of speed, or RPM, relative to the housing. The drive magnet is thereby rotated at the same RPM as the propulsion ring. The liquid then travels past the propulsion ring in a swirling pattern.

The liquid flows in a circular and downward path through a water gap between the endcap assembly and the housing and enters the housing chamber. While continuing to swirl in the housing chamber, the liquid pervades the housing chamber, exerts the rotor body downward into the rotor seat, creating a seal, and enters the internal rotor bore. Both the force exerted on the receiver magnet by the drive magnet and the force of the swirling liquid cause the rotor body to rotate about the longitudinal axis of the rotary nozzle in the housing chamber. As the rotor body rotates around housing chamber, the bearing surface is in contact with an interior side of the housing. The liquid passes through the rotor body and exits through the nozzle outlet. The orbiting motion of the rotor body causes the liquid to exit the rotary nozzle in a rotating jet.

Importantly, the magnets propel the rotor body to rotate even when the bearing surfaces exhibit wear. Because the drive magnet and the propulsion ring operate independently from the rotor body, the drive magnet continues to rotate as long as the liquid moves through the rotary nozzle.

The impact that the liquid exiting the rotary nozzle has on its target may be controlled by manipulating various characteristics of the endcap assembly. For instance, the diameter of drive insert orifice affects the rate at which the liquid exits the endcap bore into the propulsion ring, which in turn affects the rotation speed of propulsion ring, ultimately affecting the flow rate at which the liquid exits the rotary nozzle. Similarly, the geometric characteristics of the propulsion ring, as well as its mass, affect the flow rate and rotation speed of the exiting liquid. By manipulating any of these characteristics, the present invention provides effective control and maintenance of the impact of the rotating jet. By providing such control and consistency in the rotating jet, the stream quality is also thereby enhanced.

The characteristics of the drive magnet and the receiver magnet can also be manipulated to control the rotating jet. By adjusting the strength of the magnetic charge on each magnet, the force exerted by the drive magnet on the receiver magnet can effectively be influenced. Similarly, the size, shapes, and locations of the magnets can be adjusted to affect the interaction between the two magnets.

Similarly, the width of the water gap through which the liquid passes from the propulsion ring into the housing chamber affects the rotation speed of the exiting liquid as well as the flow rate at which the liquid exits the rotary nozzle. The diameter of the internal rotor bore at the exit point from the rotor body and the diameter of the rotary nozzle outlet control the flow rate at which the liquid exits the nozzle.

Further, the width of the water gap affects the startup speed; maintaining a predetermined width ensures an enhanced startup speed that minimizes the damage caused to the target being cleaned by the nozzle owing to the rapid variation in rotation speed of the fluid jet. Each desired flow rate corresponds to a specific water gap width range that will maximize the startup speed.

DETAILED DESCRIPTION OF THE INVENTION

Housing

Figure 1:
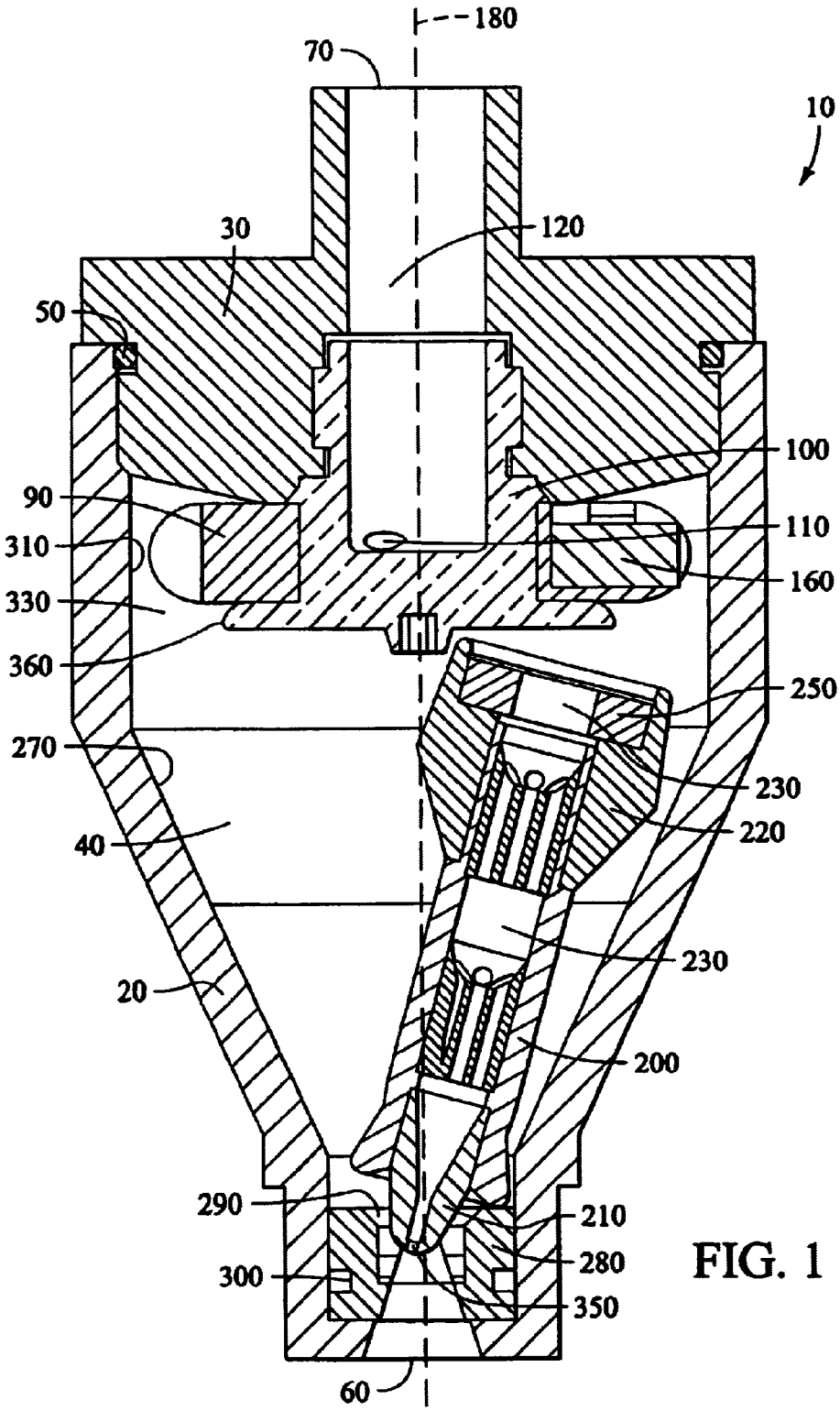
FIG. 1 is a cross-sectional view through a rotary nozzle according to the invention.

A rotary nozzle 10 illustrated in cross-section in FIG. 1 comprises a housing 20 threadedly attached to an endcap 30 at a top end of the housing, thereby defining a housing chamber 40 therein. A top o-ring 50 is positioned between endcap 30 and housing 20 creating a seal therebetween. The bottom end of housing 20 defines a nozzle outlet 60. The endcap 30 defines an endcap inlet 70, located at the top end of the endcap 30, into which a liquid can be introduced during operation of the rotary nozzle 10.

Endcap Assembly

Figure 2:
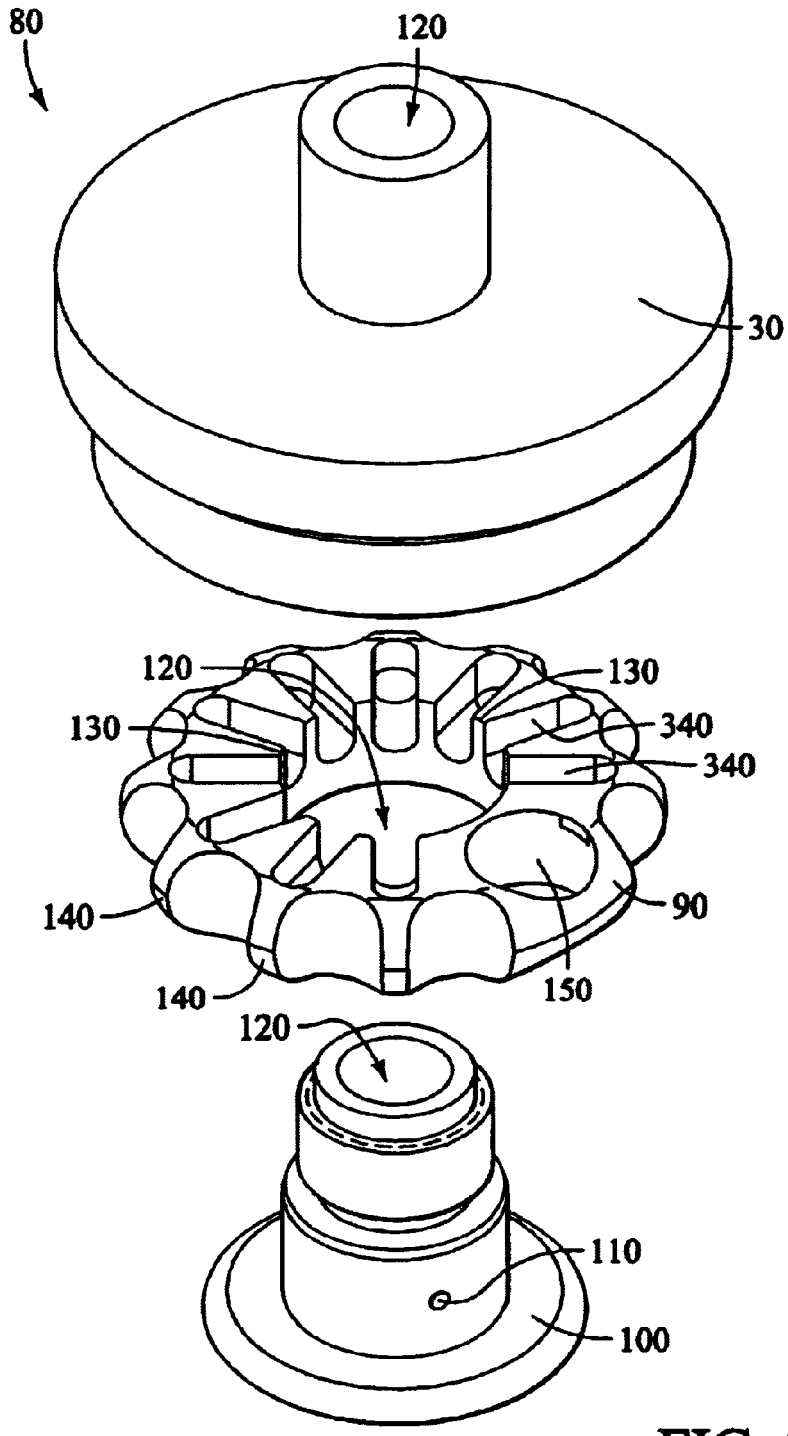
FIG. 2 is an exploded view of an endcap assembly according to the invention.

An endcap assembly 80, shown in FIG. 2, includes the endcap 30, a propulsion ring 90, and a drive insert 100. The drive insert 100 is threadedly attached to endcap 30, thereby rotatably disposing the propulsion ring 90 therebetween (see FIG. 1). The endcap inlet 70 opens into a endcap bore 120, which is a liquid channel that runs through the endcap assembly 80 along a longitudinal nozzle axis 180. As shown in FIG. 1, the endcap bore 120 terminates against a surface of the drive insert 100.

The drive insert 100 contains a drive insert orifice 110 through the side thereof, extending outward from the center of the drive insert 100 (FIG. 2). The drive insert orifice 110 is tangential to the endcap bore 120 such that the liquid introduced into the endcap inlet 70 will flow through the endcap bore 120 and exit through the drive insert orifice 110 proximate the propulsion ring 90 in a direction tangential to the endcap bore 120. The drive insert 100 may include a plurality of orifices and is not restricted to a single drive insert orifice.

The propulsion ring 90 includes a plurality of interior fins 130 and a plurality of exterior fins 140 such that the interior fins 130 extend radially towards the center of the propulsion ring 90 and the exterior fins 140 extend radially outward from the center of the propulsion ring 90 (FIG. 2). The propulsion ring 90 further includes a drive magnet brace 150 for bracing a drive magnet 160, or drive magnets, such that the drive magnet 160 and the propulsion ring 90 rotate together. The propulsion ring 90 also includes a plurality of liquid channels 340 extending radially through the propulsion ring 90 (FIG. 2).

Figure 4B:
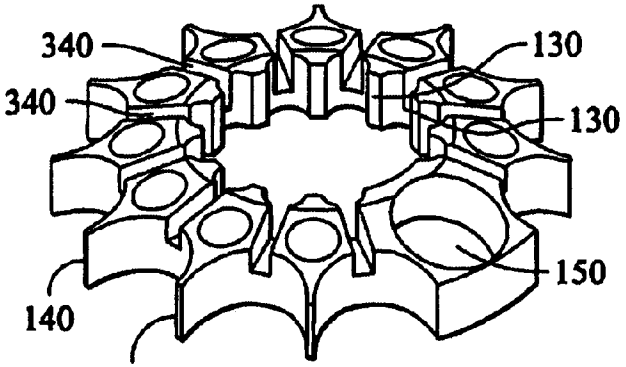
FIGS. 4A–4D are views of various embodiments of the propulsion ring according to the present invention.
Figure 4D:
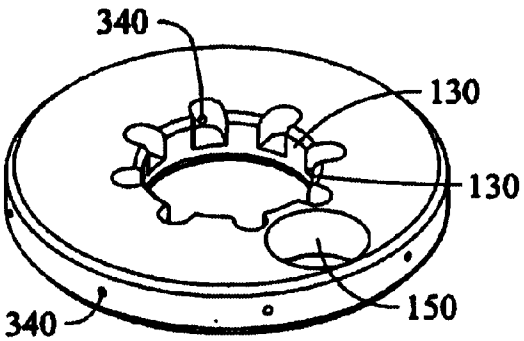
Figure 4A:
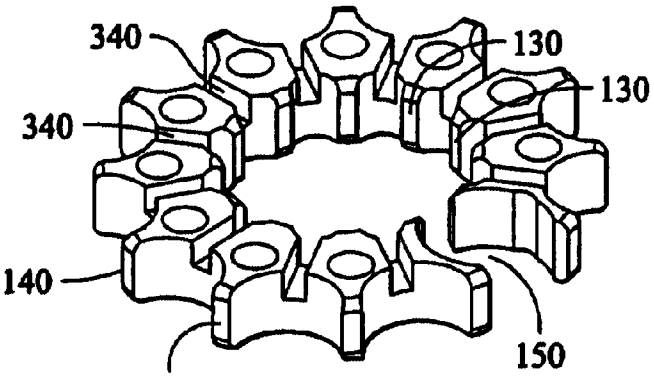
Figure 4C:
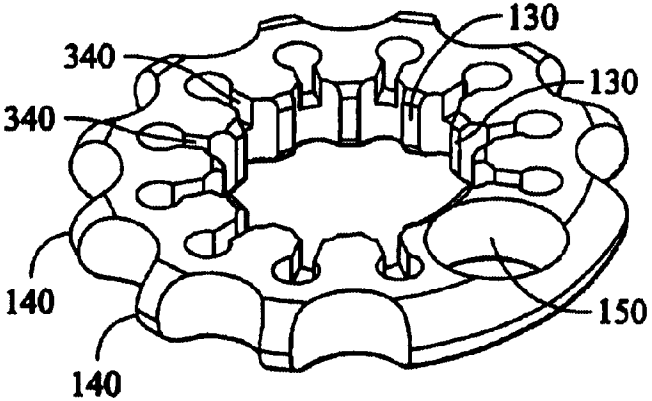

Various geometric characteristics of the propulsion ring 90 (FIG. 2) may be varied in accordance with the present invention. These characteristics include aspects of the interior fins 130, exterior fins 140, liquid channels 340, and angles defining these elements. Though the liquid channels 340 of the propulsion ring 90 do not necessarily extend the entire radius of the propulsion ring 90 (FIG. 2), the channels may extend through the entire radius propulsion ring 90 (FIG. 4A). Further, the interior fins 130 may extend close to the center of the propulsion ring 90 (FIG. 4A). The propulsion ring 90 may also be concave, as shown in FIG. 4B. The liquid channels 340 may vary in diameter, as shown in FIG. 4C, such that the liquid channels 340 diameter is not constant throughout. The liquid channels 340 may also be contained entirely with in the structure of the propulsion ring 90, as shown in FIG. 4D.

Figure 5:
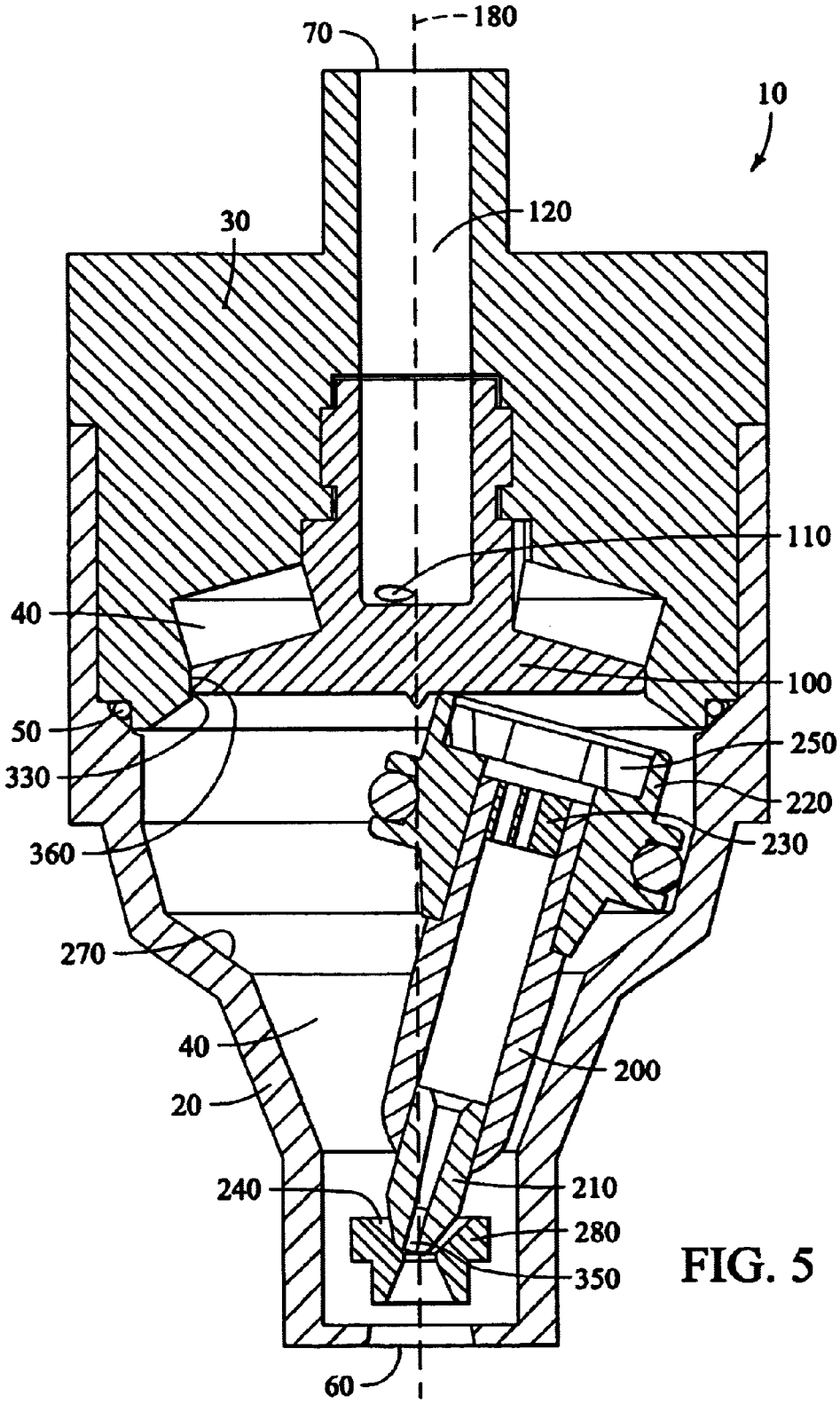
FIG. 5 is a cross-sectional view of an alternative embodiment of the rotary nozzle according to the invention.

An inside diameter of the housing 310 and an outside diameter of the drive insert 360 create a water gap 330 therebetween for allowing liquid to pass from the endcap assembly 80 into the housing chamber 40. In an alternative embodiment shown in FIG. 5, the endcap 30 extends downward past the propulsion ring 90 and the drive insert 100 such that the water gap 330 is created between an interior diameter of the endcap 30 and the outside diameter of the drive insert 360.

Rotor Assembly

Figure 3:
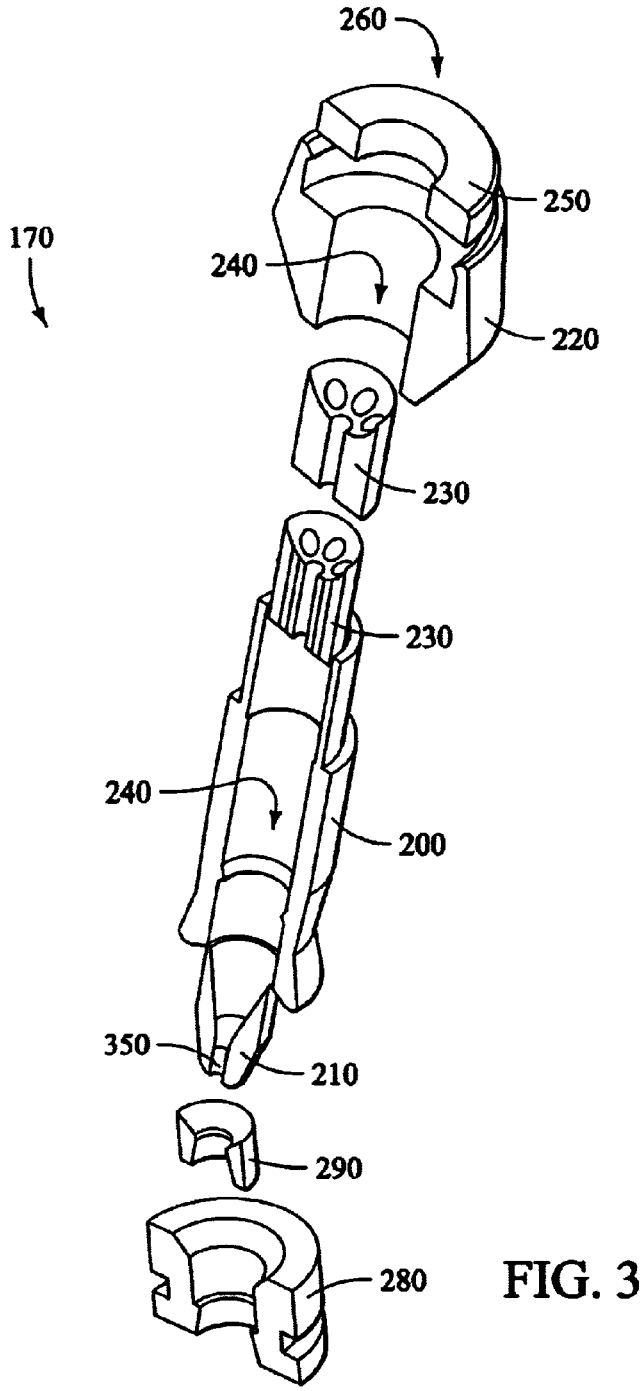
FIG. 3 is an exploded cross-sectional view of a rotor assembly according to the present invention.

FIG. 3 illustrates an expanded view of the rotor assembly 170, which is rotatably disposed in the housing chamber 40 and extends longitudinally therethrough. The rotor assembly 170 includes a rotor body 200 that defines an internal rotor bore 240, which is a liquid channel that runs through the rotor assembly 170 along a longitudinal rotor axis 190. The rotor assembly 170 further includes a flow straightener 230 disposed in the internal rotor bore 240 such that the flow straightener 230 pervades the internal rotor bore 240, a bearing 220 fixedly attached around rotor body 200, the outside diameter of bearing 220 being greater than the outside diameter of rotor body 200 at the point of attachment, and a rotor tip 210 fixedly attached to the rotor body 200. As shown in FIG. 1, the rotor assembly 170 is disposed in the housing chamber 40 at an angle with respect to the longitudinal nozzle axis 180, such that bearing 220 bears on an interior side of the housing 270. The bearing 220 is preferably made from a non-elastomer material, such as teflon, so that the coefficient of friction between the bearing 220 and the interior side of the housing 270 is low. In one embodiment, the rotor tip 210 is made from a ceramic material.

A top end of the rotor assembly 170 defines a rotor assembly inlet 260 and the rotor tip 210 defines a rotor tip outlet 350 such that a liquid introduced into the rotor assembly inlet 260 flows into the internal rotor bore 240, through the flow straightener 230 and exits the rotor assembly 170 through the rotor tip outlet 350 in the rotor tip 210. The rotor assembly 170 also includes a receiver magnet 250, which is fixedly attached to the bearing 220 such that receiver magnet 250 and the other elements of the rotor assembly 170 rotate together inside the housing chamber 40.

Returning to FIG. 1, the housing 20 tapers conically towards nozzle outlet 60, at the bottom end of housing 20. The nozzle outlet 60 surrounds a sleeve retainer 280, which is fixedly attached to the housing 20. A bottom o-ring 300 is positioned between sleeve retainer 280 and nozzle outlet 60 creating a seal therebetween. A rotor seat 290 is fixedly attached to and supported by the sleeve retainer 280. In one embodiment, rotor seat 290 is made from a ceramic material. The rotor tip 210 of the rotor assembly 170 dips into the rotor seat 290 and is thereby supported, the rotor tip 210 and the rotor seat 290 being aligned such that a liquid exiting the rotor tip 210 passes through the rotor seat 290 and sleeve retainer 280, and exits the housing 20 through the nozzle outlet 60.

Coupling

The drive magnet 160 and receiver magnet 250 are arranged to create a coupling therebetween, thereby causing the rotor body 200 to move along with the propulsion ring 90. When the propulsion ring 90 rotates, the force exerted by the drive magnet 160 on the receiver magnet 250 affects the rotor body 200 to rotate in kind. Other embodiments of the present invention may create the coupling between the propulsion ring 90 and the rotor body 200 through varying manners; it is contemplated that the propulsion ring 90 and rotor body 200 may be frictionally coupled or mechanically coupled. However, these methods of coupling are not exhaustive, there being a variety of methods for coupling the propulsion ring 90 and rotor body 200.

Operation

A liquid is introduced into the endcap inlet 70 at a high pressure and passes into the drive insert 100 through the endcap bore 120. The liquid exits the drive insert 100 through at least one drive insert orifice 110 in a direction tangential to the endcap bore 120. As the liquid exits through the drive insert orifice 110, the liquid strikes the interior fins 130 of the propulsion ring 90, thereby propelling the propulsion ring 90 to rotate at a high rate of speed, or RPM, relative to the housing 20. The drive magnet 160 is thereby rotated at the same RPM as the propulsion ring 90. Subsequent to striking the interior fins 130, the liquid travels through the liquid channels 340 and exits the propulsion ring 90. As the liquid exits the liquid channels 340, exterior fins 140 throw the liquid radially outward from the propulsion ring 90, and the liquid thereby exits the liquid channels 340 in a swirling pattern.

The liquid flows in a circular and downward path through the water gap 330 and enters housing chamber 40. While continuing to swirl in housing chamber 40, the liquid pervades the housing chamber 40, exerting the rotor assembly 170 downward against the rotor seat 290 creating a seal therebetween, and enters rotor assembly inlet 260. Both the force exerted on the receiver magnet 250 by the drive magnet 160 and the force of the swirling liquid cause the rotor body 200 to rotate about the longitudinal nozzle axis 180 in the housing chamber 40. As the rotor body 200 rotates around housing chamber 40, bearing 220 is in contact with interior side of the housing 270. Because the coefficient of friction between the bearing 220 and the interior side of the housing 270 is low, the frictional force counteracting the rotation of the rotor body 200 is minimized. The present invention may operate with any coefficient of friction; including lower coefficients such as of 0.5, and even 0.25 or lower.

The liquid passes through the rotor assembly 170 and exits the rotary nozzle 10 through the nozzle outlet 60. The orbiting motion of the rotor body 200 causes the liquid to exit the rotary nozzle 10 in a rotating jet.

Impact Control and Stream Quality

The impact that the liquid exiting the rotary nozzle 10 has on its target is affected by (1) the rotation of the liquid exiting the rotary nozzle 10, which is controlled by the speed at which the rotor body 200 rotates, and (2) the flow rate at which the liquid exits the rotary nozzle 10. This impact may be controlled by manipulating various characteristics of the endcap assembly 80.

The diameter of drive insert orifice 110 affects the rate at which the liquid exits the endcap bore 120 into the propulsion ring 90, which in turn affects the rotation speed of propulsion ring 90, ultimately affecting the flow rate at which the liquid exits the rotary nozzle 10. The greater the diameter of the drive insert orifice 110, the greater the flow rate will be of the liquid passing into the propulsion ring 90.

The geometric characteristics of the propulsion ring 90 (FIG. 2), including the interior fins 130, exterior fins 140, liquid channels 340, and angles defining these elements, affect the flow rate and rotation speed of the exiting liquid. In particular, the cross-sectional area of the liquid channels 340 determines the maximum speed at which the liquid can pass through the propulsion ring 90 and enter the housing chamber 40. The flow rate is thereby limited to the maximum rate at which the liquid travels through the liquid channels 340. The mass of the propulsion ring 90 affects the rate at which the propulsion ring 90 rotates. A less massive the propulsion ring 90 will rotate a greater rate relative to a more massive propulsion ring 90. This in turn affects the rate at which the rotor body 200 rotates and the rotation rate of the liquid exiting the rotary nozzle 10.

The length and number of the interior fins 130 similarly affect the rate at which the propulsion ring 90 rotates. The propulsion ring 90 experiences a greater rate of rotation the further towards the center of the propulsion ring 90 the interior fins 130 extend, owing to the fact that the liquid exiting the drive insert orifice 10 strikes the available surface area of the interior fins 130. The length and number of the exterior fins 140 affect the force and precise direction at which the liquid exiting the propulsion ring 90 is thrown in a swirling path into the housing chamber 40. The geometric characteristics of the liquid channels 340 can be constructed to direct the exact flow path of the liquid exiting the liquid channels 340.

Similarly, the width of the water gap 330 affects the rotation speed of the exiting liquid as well as the flow rate at which the liquid exits the rotary nozzle 10. The greater the width of the water gap 330, the greater the flow rate will be of the liquid passing into the housing chamber 40. A larger water gap 330 also facilities a faster startup speed for the rotating jet exiting the rotary nozzle 10. The diameter of the rotor tip outlet 350 and the diameter of the nozzle outlet 60 also control the rate at which the liquid exits the rotary nozzle 10.

The characteristics of the drive magnet 160 and the receiver magnet 250 can also be manipulated to control the rotating jet. A greater magnetic charge on the drive magnet 160, the receiver magnet 250, or both corresponds to a greater the force exerted by the drive magnet 160 on the receiver magnet 250. Similarly, the size, shapes, and locations of the drive magnet 160 and receiver magnet 250 are adjustable to affect the interaction between the two magnets. In one embodiment, the receiver magnet 250 constitutes a plurality of magnets distributed at particular intervals in the rotor assembly 170 (not shown).

It is contemplated that features disclosed in this application, as well as those described in the above applications, incorporated by reference, can be mixed and matched to suit particular circumstances. Various other modifications and changes will be apparent to those of ordinary skill in the art without departing from the spirit and scope of the present invention. Accordingly, reference should be made to the claims to determine the scope of the present invention.

What is claimed is:

1. A high-pressure rotary nozzle, comprising:

a housing defining an internal chamber, the housing having a top end and a bottom end, the bottom end having an outlet;

a rotatable propulsion ring operably retained in the chamber, the propulsion ring having a radial liquid channel therethrough such that a liquid introduced into the propulsion ring strikes the propulsion ring and passes through the liquid channel into the chamber, thereby causing the propulsion ring to rotate with respect to the housing;

a rotor body operably contained within the chamber proximate to the bottom end of the housing, the rotor body having an internal rotor bore therethrough such that the liquid in the chamber further passes through the internal rotor bore; and a magnetic coupling between the propulsion ring and the rotor body causing the rotor body to move along with the propulsion ring wherein the coupling causes the rotor body to rotate such that the liquid exits the internal rotor bore and the chamber in a conical rotating jet.

2. The rotary nozzle of claim 1 wherein the coupling comprises a drive magnet fixedly attached to the propulsion ring and a receiver magnet fixedly attached to the rotor body.

3. The rotary nozzle of claim 1 wherein the propulsion ring includes a plurality of fins, such that the plurality of fins extend radially inward and such that the liquid strikes the plurality of fins thereby causing the propulsion ring to rotate.

4. A high-pressure rotary nozzle, comprising:

a housing defining an internal chamber, the housing having a top end and a bottom end, the bottom end having an outlet;

an endcap assembly attached to the top end of the housing and having an endcap bore therethrough, the endcap bore opening into a drive orifice that is tangential to the endcap bore, wherein the endcap assembly includes an endcap and a drive insert, such that the drive insert is threadedly attached to the endcap;

a propulsion ring rotatably disposed between the endcap and the drive insert such that a liquid introduced into the endcap bore passes through the drive orifice, strikes the propulsion ring thereby causing the propulsion ring to rotate, and subsequently enters the chamber;

a drive magnet fixedly attached to the propulsion ring such that the drive magnet and the propulsion ring rotate together;

a rotor body rotatably disposed in the chamber, wherein the rotor body has an internal rotor bore therethrough and is rotatably supported by the housing at the bottom of the housing, the rotor body extending in a longitudinal direction along a portion of the housing, the rotor body having a bearing surface thereon that bears on an interior side of the housing;

a receiver magnet fixedly attached to the rotor body, wherein rotation of the drive magnet causes the rotor body to move along with the propulsion ring such that the liquid flows through the internal rotor bore and exits the outlet in a conical rotating jet.

5. The rotary nozzle of claim 4, wherein the liquid strikes the propulsion ring and passes through a radial liquid channel therethrough, entering the chamber through a water gap between the inside diameter of the housing and the outside diameter of drive insert.

6. The rotary nozzle of claim 5, wherein the width of the water gap controls the flow rate and the rotational speed of the exiting liquid.

7. A method for achieving and maintaining a desired spray rotation speed in a high-pressure rotary nozzle that forms a housing, the housing defining an internal chamber and having a top end and a bottom end, the bottom end of the housing having an outlet, and the rotary nozzle including a propulsion ring proximate the top end of the housing and a rotor body disposed in the chamber wherein the propulsion ring and the rotor body are magnetically coupled, and wherein the rotary nozzle includes an endcap, attached to the top end of the housing, and a drive insert, such that the drive insert is threadedly attached to the endcap, thereby rotatable disposing the propulsion ring therebetween, the method comprising:

injecting a liquid supply into the housing, wherein the liquid tangentially strikes the propulsion ring and enters the chamber, thereby causing the propulsion ring to rotate, which in turn causes the coupled rotor body to conically rotate, thus creating a conical rotating jet as the liquid exits the chamber through the outlet.

8. The method of claim 7, wherein the liquid strikes the propulsion ring and passes through a radial liquid channel therethrough, passing through a water gap between the inside diameter of the housing and the outside diameter of the drive insert.

9. The method of claim 8, wherein the width of the water gap controls the flow rate and the rotational speed of the exiting liquid.

10. A method for achieving and maintaining a desired spray rotation speed and flow rate in a high-pressure rotary nozzle, the method comprising:

injecting a liquid supply into a nozzle housing, the liquid following a flow path wherein:

the liquid enters the nozzle housing along the longitudinal axis thereof through an endcap bore, the liquid passes from the endcap bore along the latitudinal axis thereof through a drive orifice that is tangential to the endcap bore, striking a propulsion ring causing the propulsion ring to rotate with respect to the nozzle housing, the liquid passes through the propulsion ring via a radial liquid channel therein, the liquid enters a housing chamber in a spirally motion along the longitudinal axis of the nozzle housing, the liquid filling the housing chamber, passes through a rotor body therein via an internal rotor bore therethrough, the liquid exits the nozzle housing;

providing a magnetic coupling between the propulsion ring and the rotor body causing the rotor body to move along with the propulsion ring such that the rotor body causes the liquid to exit the nozzle housing in a conical rotating jet.

11. The method of claim 10 wherein the geometrical characteristics of the propulsion ring control its rotational speed and the flow rate and the rotational speed of the exiting liquid.

12. The method of claim 10, wherein the mass of the propulsion ring controls its rotational speed and the flow rate and the rotational speed of the exiting liquid.

13. The method of claim 10, wherein a diameter of the drive orifice controls the rotational speed of the propulsion ring and the flow rate and the rotational speed of the exiting liquid.

14. The method of claim 10, wherein a diameter of a bottom end of the internal rotor bore controls the flow rate of the exiting liquid.

15. The method of claim 10, wherein the rotary nozzle includes an endcap, attached to the nozzle housing, and a drive insert, such that the drive insert is threadedly attached to the endcap, thereby rotatably disposing the propulsion ring therebetween.

16. The method of claim 15, wherein the liquid strikes the propulsion ring and passes through the liquid channel therethrough, entering the housing chamber through a water gap between the inside diameter of the nozzle housing and the outside diameter of the drive insert.

17. The method of claim 16, wherein the size of the water gap controls the flow rate and the rotational speed of the exiting liquid.

18. The method of claim 10, wherein the rotor body has a bearing surface thereon that bears on an interior side of the housing.

19. The method of claim 18, wherein the bearing surface consists of a non-elastomer material.

20. The method of claim 10 wherein the coupling comprises a drive magnet fixedly attached to the propulsion ring and a receiver magnet fixedly attached to the rotor body.

* * * * *

UNITED STATES PATENT AND TRADEMARK OFFICE

CERTIFICATE OF CORRECTION

PATENT NO. : 6,766,967 B2 
DATED : July 27, 2004
INVENTOR(S) : Jaime L. Harris, Gary A. Brown and Brad S. Kessler It is certified that error appears in the above-identified patent and that said Letters Patent is hereby corrected as shown below:

Column 8,
Line 39, delete “rotatable” and insert -- rotatably --

Signed and Sealed this

Twenty-second Day of February, 2005

JON W. DUDAS
*Director of the United States Patent and Trademark Office*